US009695824B2

(12) United States Patent
Okoroafor

(10) Patent No.: US 9,695,824 B2
(45) Date of Patent: Jul. 4, 2017

(54) PUMP WITH CORROSION RESISTANT SHAFT AND ROTOR SURFACES

(76) Inventor: Emmanuel Uzoma Okoroafor, Southampton (GB)

( * ) Notice: Subject to any disclaimer, the term of this patent is extended or adjusted under 35 U.S.C. 154(b) by 546 days.

(21) Appl. No.: 13/394,966

(22) PCT Filed: Aug. 31, 2010

(86) PCT No.: PCT/GB2010/051432

§ 371 (c)(1),
(2), (4) Date: Mar. 8, 2012

(87) PCT Pub. No.: WO2011/036468

PCT Pub. Date: Mar. 31, 2011

(65) Prior Publication Data

US 2012/0171033 A1 Jul. 5, 2012

(30) Foreign Application Priority Data

Sep. 23, 2009 (GB) ..... 0916708.1

(51) Int. Cl.
*F04D 29/04* (2006.01)
*F04C 29/00* (2006.01)
*F04C 18/12* (2006.01)

(52) U.S. Cl.
CPC ..... *F04C 29/0078* (2013.01); *F04C 18/123* (2013.01); *F04C 18/126* (2013.01); *F04C 2220/12* (2013.01); *F04C 2240/20* (2013.01); *F04C 2280/04* (2013.01); *F05C 2201/0442* (2013.01)

(58) Field of Classification Search
CPC ..... F04C 18/12; F04C 18/123; F04C 18/126; F04C 29/0078; F04C 2220/12; F04C 2240/20; F04C 2280/04
USPC ..... 415/72, 173.1, 200, 201.1
See application file for complete search history.

(56) References Cited

U.S. PATENT DOCUMENTS 2,487,449 A 11/1949 Knudson
3,373,485 A * 3/1968 Nelsen ..... 29/598
4,497,290 A * 2/1985 Harris ..... 123/179.11
4,601,583 A * 7/1986 Amorese ..... B01F 7/00016 366/330.1

(Continued)

FOREIGN PATENT DOCUMENTS

EP 1055823 A1 11/2000
EP 1640611 A2 3/2006
GB 641372 A * 8/1950 ..... F04D 7/065

OTHER PUBLICATIONS

Gottschlich U et al: "Dry Running Vacuum Pumps Become Dominant Choice" Pumps Magazine, vol. 45, Mar. 1, 20004, pp. 12-14, XP000962412

(Continued)

*Primary Examiner* — Woody Lee, Jr.

(57) ABSTRACT

A pump shaft (10; 12) and a pump member (16; 18) mountable on the shaft for rotation with the shaft have respective contact surfaces that contact when the pump member is mounted on the shaft. At least one of the contact surfaces is formed such that corrosion products of the surface are substantially incompatible with the other contact surface so that joining of the shaft and pump member at the contact surfaces by corrosion is substantially prevented. The pump shaft and pump member may be parts of a dry pump.

14 Claims, 2 Drawing Sheets

(56) References Cited

U.S. PATENT DOCUMENTS

| | | | | |
|---|---|---|---|---|
| 5,401,149 | A * | 3/1995 | Tsuru et al. | 418/178 |
| 6,139,298 | A * | 10/2000 | Kojima et al. | 418/152 |
| 6,371,723 | B1 * | 4/2002 | Grant et al. | 415/200 |
| 2001/0043876 | A1 * | 11/2001 | Mekler | F01C 1/28 418/36 |
| 2006/0245955 | A1 * | 11/2006 | Horiuchi et al. | 417/420 |
| 2007/0041860 | A1 * | 2/2007 | Nakamoto | F01C 21/08 418/123 |
| 2007/0297907 | A1 | 12/2007 | Giebmanns | |

OTHER PUBLICATIONS

U.K. Search Report dated Jan. 22, 2010 for corresponding British Application No. GB0916708.1.

PCT International Search Report dated Jan. 19, 2012 for corresponding PCT Application No. PCT/GB2010/051432, filed Aug. 31, 2010.

PCT Written Opinion dated Jan. 19, 2012 for corresponding PCT Application No. PCT/GB2010/051432, filed Aug. 31, 2010.

Examination Report dated Nov. 19, 2014 for corresponding British Application No. GB0916708.1.

British Examination Report dated Sep. 25, 2015 for corresponding British Application No. GB0916708.1.

Decision dated Sep. 17, 2015 for corresponding Taiwanese Application No. 099127474.

British Examination Report dated May 15, 2015 for corresponding British Application No. GB0916708.1.

* cited by examiner

PUMP WITH CORROSION RESISTANT SHAFT AND ROTOR SURFACES

The invention relates to vacuum pumps and particularly, but not exclusively, to dry pumps used to provide a vacuum environment.

A dry pump is one in which there is no lubrication provided in the pumping chamber of a dry pump. Despite an absence of lubrication, dry pumps are often used to pump corrosive fluids. For example, dry pumps are used to control the process environment during semiconductor processing, a usage that involves pumping highly corrosive chemicals such as fluorine, chlorine, bromine and their reactive species. Corrosion of parts in the pumping chamber due to the lack of a protective lubricant can affect pumping performance and sometimes leads to seizure and, hence, pump failure.

In dry pumps that do not have integral shaft-rotors, i.e. the rotor member is mounted on the shaft, corrosion often results in joining, or welding, of the rotors to the shafts/sleeves. This effect is particularly noticeable in low vacuum stages of a dry pump where there is more corrosion of the pump parts due to increased temperature and pressure resulting from gas compression.

The welding together of the rotors and sleeves/shafts makes it difficult to remove the rotors for maintenance or remanufacture. Often it is necessary to use torches, hammers and/or chisels to free the parts. This can result in damage to bearings, rotors and sleeves that then have to be replaced. This leads to increased component usage and labour time and a reduction in sustainability.

To reduce the corrosion problem, it is known to apply a graphite spray to the shaft/sleeve. This has made loading (mounting) and removing for example Northey, or claw, rotors on the shaft/sleeve easier. It is also known to spray polytetrafluoroethylene (PTFE) on shafts/sleeves. The problem with using sprays or powders in this way is that highly corrosive gases such as fluorine quickly eat away the coating and so for pumps that may be used to pump such gases, alternative solutions are desirable.

The present invention provides a pump shaft and a pump member mountable on said shaft for rotation therewith, said shaft and pump member having respective contact surfaces that contact or engage one another when said pump member is mounted on said shaft and at least one of said contact surfaces being formed such that corrosion products thereof are substantially incompatible with the other contact surface so that joining of said shaft and pump member at said contact surfaces by corrosion is substantially prevented.

The present invention also includes a pump shaft and a pump member mountable on said shaft for rotation therewith, said shaft and pump member having respective contact surfaces that contact or engage one another when said pump member is mounted on said shaft and said contact surfaces being formed such that respective corrosion products thereof are substantially incompatible so that joining of said shaft and pump member at said contact surfaces by corrosion is substantially prevented.

The present invention also includes a dry pump comprising a pumping chamber and having a first member at least partially disposed in said pumping chamber and a second member mounted on said first member in said pumping chamber, said first member having a first member contact surface that is in contact with a contact surface of said second pump member, one of said first and second member contact surfaces being formed such that corrosion products that form in use of said dry pump will be spatially incompatible with the other of said contact surfaces.

In order that the invention may be well understood, some embodiments thereof, which are given by way of example only, will now be described with reference to the drawings in which.

Figure 1:
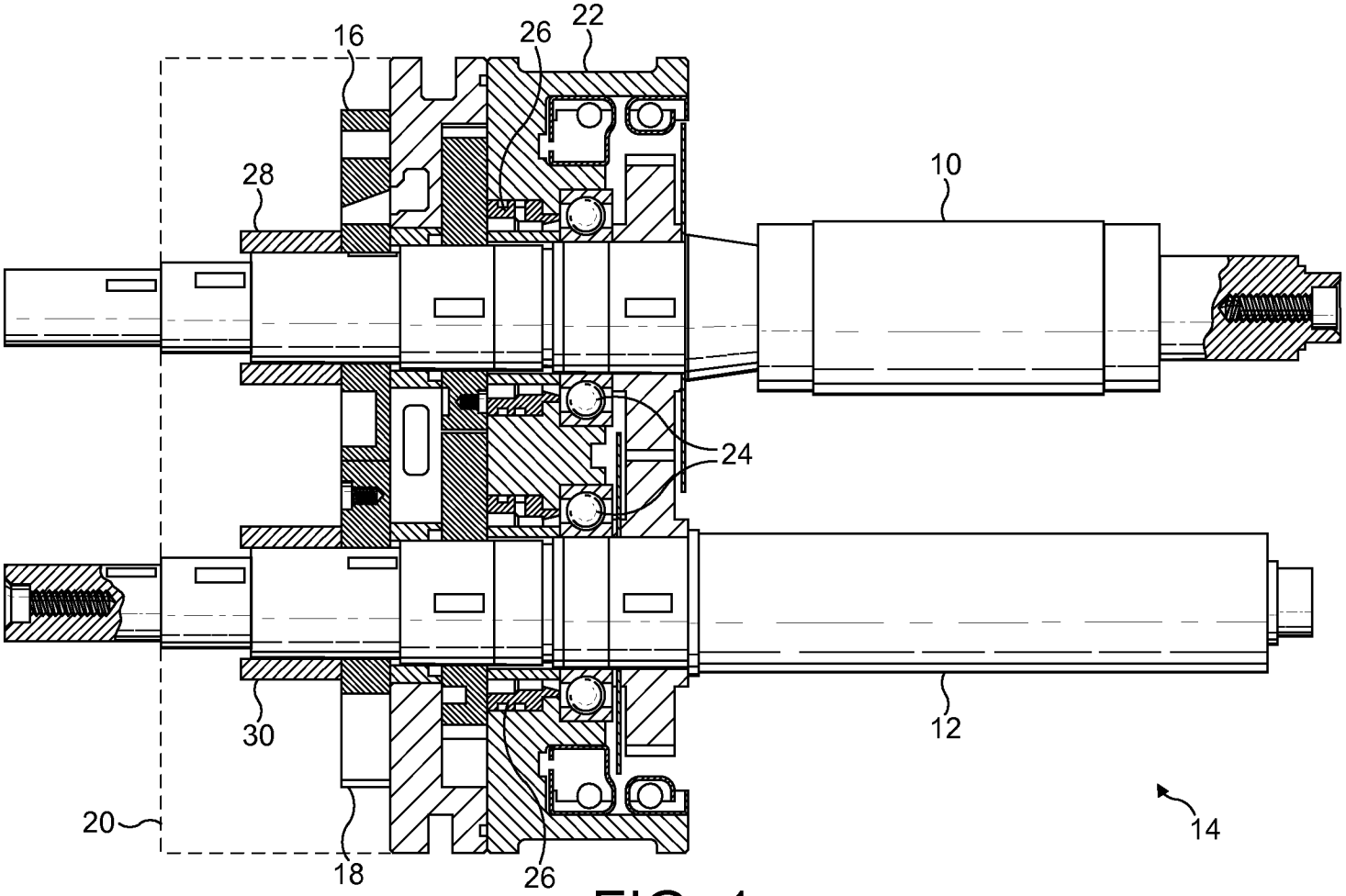
FIG. 1 is a schematic representation of a dry pump according to the present invention.

Referring to FIG. 1, a first shaft 10 and a second shaft 12 of a vacuum dry pump 14 are shown supporting respective rotors 16, 18 for example in a roots or claw pump. The rotors 16, 18 are a slide fit on the shafts 10, 12 and are secured to the shafts by keys or other suitable securing devices such that they rotate with the shafts. The rotors 16, 18 are located in a pumping chamber 20 that is in part defined by a head plate 22. The head plate 22 is fitted with roller bearings 24 that provide support for the shafts 10, 12 and seal systems 26 that prevent lubricants from entering the pumping chamber 20 and the escape of pumped fluids between the shafts and head plate. Respective sleeves 28, 30 are provided on the shafts 10, 12 within the pumping chamber 20. The pumping chamber 20 and rotors 16, 18 are configured such that rotation of the rotors causes fluids to be pumped through the pumping chamber. As explained in more detail below, the shafts 10, 12 have contact surfaces 32 that mate with respective contact surfaces 34 of the rotors 16, 18. In the illustrations, the contact surfaces 34 of the rotors 16, 18 are bores in which the contact surfaces 32 of the shafts 10, 12 are received.

Those skilled in the art will be familiar with the construction and operation of vacuum dry pumps such as claw and roots pumps. For that reason and since further description of a dry pump is not needed in order to understand the invention, other parts and operation of the dry pump will not be described herein.

Figure 2:
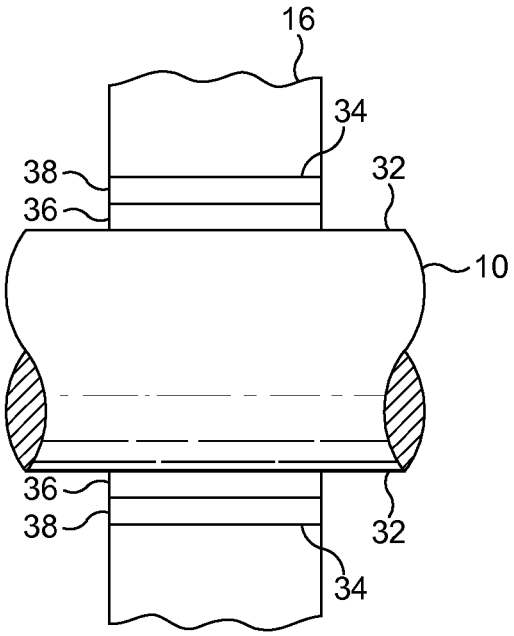
FIG. 2 is a schematic representation of corrosion layers between a shaft and rotor of a dry pump such as the dry pump of FIG. 1.
Figure 3:
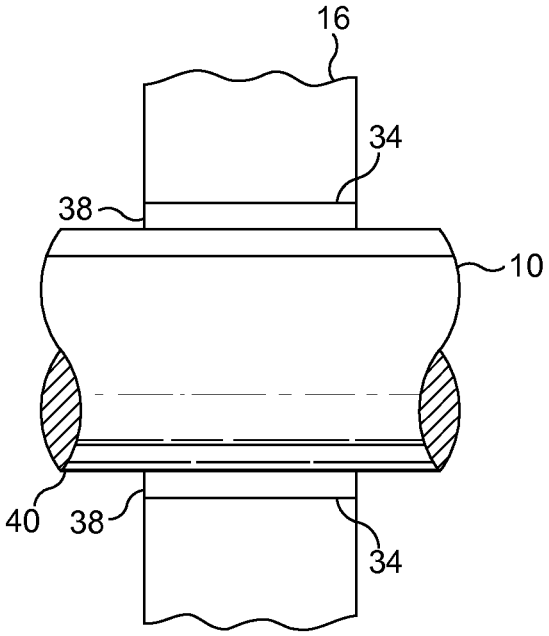
FIG. 3 is a schematic representation of a corrosion layer between a rotor and a coated surface of a shaft of a dry pump such as the dry pump of FIG. 1.

Referring to FIGS. 2 and 3, an aspect of the invention resides in forming at least one contact surface 32, 34 of the shafts 10, 12 and rotors 16, 18 such that in the event of corrosion thereof, the corrosion product of that surface is incompatible with the other surface so that corrosion in the area between the contact surfaces should not cause the surfaces to join in such a way that it becomes difficult to remove the rotors from the shafts.

Referring to FIG. 2, the contact surface 32 of the shaft 10 has corroded and a corrosion layer 36 has formed thereon. Similarly, the contact surface 34 of the rotor 16 has corroded and a corrosion layer 38 has formed thereon. The corrosion layers 36, 38 are incompatible so that they will generally not join or weld together. The result is that despite this corrosion, the shaft 10 and rotor 16 should be relatively easy to separate should it become desirable to dismantle them. In cases in which the gases to which the pump will be exposed will lead to the formation of corrosion layers primarily comprised of fluorides, the contact surfaces 32, 34 are formed such that the fluoride layers formed are chemically and spatially incompatible with one another so that generally they will not join together.

Referring to FIG. 3, the contact surface 34 of the rotor 16 has corroded and a corrosion layer 38 has formed thereon. The contact surface of the shaft 10 comprises a coating 40 that is incompatible with the corrosion layer 38 so that generally they will not join or weld together. The result is that despite corrosion of the rotor contact surface 38, the shaft 10 and rotor 16 should be relatively easy to separate should it become desirable to dismantle them. In cases in which the gases to which the pump will be exposed will lead to the formation of a corrosion layer primarily comprised of fluorides, the coating of the shaft is formed is such that it is chemically and spatially incompatible with such the fluoride corrosion layer.

It will be understood that for ease of representation the thickness of the corrosion layers and coating shown in FIGS. 2 and 3 is considerably exaggerated.

Six specific embodiments will now be described in the context of pump usage in an environment in which the parts of the pumping chamber 20 will be exposed to chemicals that cause the formation of corrosion products that are primarily fluorides.

In a first embodiment, the shafts 10, 12 are made of sintered silicon carbide (SiC) and the rotors 16, 18 are made of a ferrous material, for example a cast iron such as spheroidal graphite cast iron. If the respective contact surfaces 32, 34 of the shafts 10, 12 and rotors 16, 18 corrode, the corrosion product of the SiC shafts will be incompatible with the iron fluoride corrosion product of the cast iron rotors. Further advantages of a SiC shaft include:

i) high thermal conductivity;

ii) low thermal expansion coefficient;

iii) exceptional shock resistance;

iv) SiC is not attacked by any acids, alkalis or molten salts up to temperatures around 800° C.; and v) SiC forms a protective silicon oxide ($SiO_2$) coating at temperatures around 1200° C. and can be used at temperatures up to around 1800° C.

In a second embodiment, the contact surfaces of the shafts 10, 12 or the rotors 16, 18 comprise a fluoropolymer coating and the mating contact surfaces are formed of a ferrous material such as cast iron, for example spheroidal graphite cast iron. In this case, the iron fluoride corrosion product of the ferrous contact surfaces is incompatible with the fluoropolymer and so there will be substantially no welding of the rotors 16, 18 to the shafts 10, 12.

In a third embodiment, the contact surfaces of the shafts 10, 12 comprise a diamond-like carbon coating and the mating contact surfaces of the rotors 16, 18 are formed of a ferrous material such as cast iron, for example spheroidal graphite cast iron. Diamond-like carbon coatings are films of amorphous carbon materials that display some of the properties of natural diamond. Diamond-like carbon coatings are used where improved hardness and wear resistance are required. Diamond-like carbon coatings may, for example, be applied by primary ion beam deposition of carbon atoms, by sputter deposition of carbon or deposition from an RF plasma.

If the diamond-like carbon coating does corrode, the corrosion products (carbon fluorides) are incompatible with the iron fluoride corrosion products of the contact surfaces of the rotors and so there will be substantially no welding between the shafts and rotors.

In a fourth embodiment, the contact surfaces of the shafts 10, 12 are aluminised and the contact surfaces of the rotors they mate with are formed of a ferrous material such as cast iron, for example spheroidal graphite cast iron. Aluminised products are produced by hot dipping a ferrous material in an aluminium-silicon alloy. This process produces a tight metallurgical bond between the ferrous substrate and the alloy coating, producing a part that shows good resistance to corrosion.

If the aluminised surfaces do corrode, the corrosion products are incompatible with the iron fluoride corrosion products of the contact surfaces of the rotors and so there will be substantially no welding between the shafts and rotors.

In a fifth embodiment, the contact surfaces of the shafts 10, 12 or rotors 16, 18 comprise a black oxide of iron and polymer film surface and the mating contact surfaces of the rotors are formed of a ferrous material such as cast iron, for example spheroidal graphite cast iron.

If the black oxide and polymer film surface does corrode, the corrosion products are incompatible with the iron fluoride corrosion products of the rotors and so there will be substantially no welding between the shafts and rotors. The corrosion products of the cast iron rotor will be incompatible with corrosion products of the coating. Similarly, the corrosion products of the cast iron rotor are incompatible with the black oxide/polymer film and vice versa.

In a sixth embodiment, the contact surfaces of the shafts 10, 12 or rotors 16, 18 comprise a zinc coating, for example a yellow zinc coating, and the mating contact surfaces of the rotors are formed of a ferrous material such as cast iron, for example spheroidal graphite cast iron. The yellow zinc coating is preferable compliant with hazardous substances regulations such as the European Union Restriction of Hazardous Substances Directive 2002/95.

If the zinc coated surfaces do corrode, the corrosion products (zinc fluorides) are incompatible with the iron fluoride corrosion products of the rotors and so there will be substantially no welding between the shafts and rotors.

In a seventh embodiment, the contact surfaces of the shafts 10, 12 or rotors 16, 18 comprise nickel plating and the other surface is iron. Nickel fluoride is not compatible with iron fluoride. Furthermore, nickel does not corrode significantly in fluorine.

It will be appreciated that although the shafts in the illustrated embodiment are solid shafts, the shafts may be tubular or part hollow.

It will be appreciated that the invention is not limited to the shafts and rotors of dry pumps. For example, the contact surfaces could be those of a shaft and sleeve of a dry pump. Alternatively, the contact surfaces could be surfaces of sleeves, shafts and/or rotors in any pump and particularly pumps that are intended to pump fluids that are likely to cause corrosion of the contact surfaces.

The materials selected for the described embodiments are for pumps suitable for pumping gases, such as fluorine, that will cause fluoride corrosion. It will be appreciated that for applications in which different corrosion products can be expected, the materials should be selected such that the corrosion products will be incompatible so that there will be substantially no joining of welding at the contact surfaces due to corrosion caused by the pump fluids the parts are intended to encounter so that the parts can be readily disassembled.

The invention claimed is:

1. An apparatus comprising:

a multi-stage dry vacuum pump shaft and a vacuum pump member removably mounted on said shaft for rotation therewith, said shaft and pump member located at least partially within a sealed pumping chamber provided in operation with a source of fluoride, and said shaft and pump member having respective contact surfaces that face each other and are positioned relative to each other to allow the formation of two layers of corrosion products between the contact surfaces, wherein a first layer of corrosion products comprises a first type of fluoride and is formed from the corrosion of the shaft, and a second layer of corrosion products comprises a second type of fluoride and is formed from corrosion of the pump member, and wherein the first and second layers of corrosion products are substantially incompatible with each other so that joining of said shaft and pump member at said contact surfaces by corrosion is substantially prevented, and wherein said pump member is a claw or roots rotor and the contact surface thereof is defined by a bore in which the contact surface of said shaft is received when said rotor is mounted on said shaft.

2. The apparatus as claimed in claim 1, wherein at least the contact surface of one of said shaft and pump member is made of sintered silicon carbide and at the least the contact surface of the other of said shaft and pump member is made of a material having corrosion products incompatible with the corrosion products of sintered silicon carbide.

3. The apparatus as claimed in claim 1, wherein at least the contact surface of one of said shaft and pump member has a diamond-like carbon coating and at the least the contact surface of the other of said shaft and pump member is made of a material having corrosion products incompatible with corrosion products of said diamond-like carbon coating.

4. The apparatus as claimed in claim 1, wherein at least the contact surface of one of said shaft and pump member is aluminised and at least the contact surface of the other of said shaft and pump member is made of a material having corrosion products incompatible with the corrosion products of said aluminised contact surface.

5. The apparatus as claimed in claim 1, wherein at least the contact surface of one of said shaft and pump member is zinc plated and at the least the contact surface of the other of said shaft and pump member is made of a material having corrosion products incompatible with the corrosion products of said zinc plated contact surface.

6. The apparatus as claimed in claim 1, wherein at least the contact surface of one of said shaft and pump member has a black oxide polymer film coating and at the least the contact surface of the other of said shaft and pump member is made of a material having corrosion products incompatible with the corrosion products of said black oxide polymer film coating.

7. The apparatus as claimed in claim 1, wherein said material from which the contact surface of one of said shaft and pump member is made is a ferrous material.

8. The apparatus as claimed in claim 7, wherein the corrosion product of said ferrous material is iron fluoride.

9. The apparatus as claimed in claim 7, wherein said ferrous material comprises spheroidal graphite cast iron.

10. The apparatus as claimed in claim 7, wherein the contact surface of the other of said shaft and pump member is made of sintered silicon carbide.

11. The apparatus as claimed in claim 7, wherein the contact surface of the other of said shaft and pump member has a diamond-like carbon coating.

12. The apparatus as claimed in claim 7, wherein the contact surface of the other of said shaft and pump member is aluminised.

13. The apparatus as claimed in claim 7, wherein the contact surface of the other of said shaft and pump member is zinc plated.

14. The apparatus as claimed in claim 7, wherein the contact surface of the other of said shaft and pump member has a black oxide polymer film coating.

* * * * *